United States Patent [19]

Hörler et al.

[11] 4,123,200

[45] Oct. 31, 1978

[54] GAS-DYNAMIC PRESSURE-WAVE MACHINE

[75] Inventors: Hansulrich Hörler, Zurich; Josef Perevuznik, Baden, both of Switzerland

[73] Assignee: BBC Brown Boveri & Company Limited, Baden, Switzerland

[21] Appl. No.: 541,247

[22] Filed: Jan. 15, 1975

[30] Foreign Application Priority Data

Feb. 14, 1974 [CH] Switzerland ..... 2088/74

[51] Int. Cl.[2] ..... F04B 11/00

[52] U.S. Cl. ..... 417/64

[58] Field of Search ..... 417/64; 60/39.45, 39.32; 415/128, 138

[56] References Cited

U.S. PATENT DOCUMENTS

| | | | |
|---|---|---|---|
| 2,004,777 | 6/1935 | Bassler | 415/178 |
| 2,836,346 | 5/1958 | Vendrassik | 417/64 |
| 3,291,379 | 12/1966 | Herger et al. | 417/64 |
| 3,591,313 | 7/1971 | Wunsch | 417/64 |

*Primary Examiner*—William L. Freeh

*Attorney, Agent, or Firm*—Burns, Doane, Swecker & Mathis

[57] ABSTRACT

A gas-dynamic pressure-wave machine comprises essentially a celled rotor operating within a stationary casing that includes a cylindrical middle portion coextensive in length with the rotor and two side casing portions located respectively adjacent opposite ends of the rotor for entrance and discharge of a hot high-pressure gas and a cold gas respectively which flow through the cells, some of the energy in the hot high-pressure gas being imparted to the cold gas so as to cause the latter to be compressed as a result of the pressure-wave process which takes place within the cells. The rotor becomes heated by the hot gas to an operating temperature between those of the cold gas, to be compressed, e.g. air and the hot gas, e.g. engine exhaust gas causing it to expand in an axial direction. In order to prevent any rubbing action between the surfaces of the two side casing portions and the opposite ends of the rotor and yet maintain a desirable small operating axial clearance therebetween, the middle portion of the casing, for each duty point of the machine, is heated approximately simultaneously with the rotor to a temperature which is at least approximately proportional to the average rotor temperature at that duty point. The required heating of the middle portion of the casing is accomplished by passing some of the hot gas through a channel formed between the periphery of the rotor and the adjacent inner surface of the middle casing portion and/or through a channel formed between the outer surface of the middle casing portion and a jacket surrounding the latter.

5 Claims, 5 Drawing Figures

GAS-DYNAMIC PRESSURE-WAVE MACHINE

This invention concerns a method of operating a gas-dynamic pressure-wave machine the rotor of which, comprising essentially a shaft, a hub, cell walls and a shroud, rotates in a fixed casing composed of a middle portion and side portions, and in this machine air is compressed to a higher pressure by a hot gas, the rotor being heated by the gas to an operating temperature between the air temperature and gas temperature; the invention further concerns apparatus for implementing the method.

For a gas-dynamic pressure-wave machine to function correctly, and in order to achieve a high efficiency, it is necessary to limit gas-leakage losses at the end faces of the rotor to a minimum, i.e. to maintain a very small axial clearance between the rotor and the side portions of the casing.

Since the gas to be compressed is usually air, for the sake of simplicity only this medium will be considered in the following, and accordingly that side portion of the casing which normally contains both the low-pressure air inlet ducts and the high-pressure air outlet ducts is termed the air casing, while the other side portion, which contains the high-pressure gas inlet ducts and the low-pressure gas outlet ducts, is termed the gas casing.

The axial clearance between the rotor and the air casing can be kept very small because the rotor is usually overhung from a bearing in the air casing, and any differences of expansion are insignificant. The situation is much more difficult at the gas end, where the expansion of the hot rotor takes full effect. The gap between the rotor and the gas casing which determines the axial clearance is itself determined by the difference in expansion between the rotor and the middle portion of the casing. When the pressure-wave machine is started, the hot gas flows through the cells of the rotor, whereupon the latter expands towards the casing in accordance with its temperature and the thermal expansion coefficient of its material. The axial gap thus becomes smaller because the casing middle portion cannot follow so quickly, this portion being heated by the leakage gases in the radial gap between the shroud of the rotor and the middle portion, but also by radiation from the rotor, following a time lag. After a certain time the axial gap attains a minimum, known as the starting minimum. At full load the axial clearance can be greater or smaller than the starting minimum, depending on the operating condition of the machine. Since the rotor must under no circumstances and under no operating conditions rub against the gas casing, these minimum clearances govern the clearance to which the cold machine is to be set on assembly. The rotor contains a constantly alternating flow of hot gas and cold air, so that its temperature settles to a value between the gas and air temperatures. In the event of overload, when the rotor is overfilled with gas, its temperature approaches that of the gas, the temperature of the casing middle portion can no longer follow entirely and the gap becomes smaller.

A known method of keeping the axial clearance between the rotor and the side portions of the casing small (DT-AS 17 28 083.0) consists in making the rotor and the casing middle portion of an alloy with a high nickel content and a small average thermal expansion coefficient. Because the variations in length of the rotor and the casing middle portion are then only small, the axial clearance can be made small from the beginning, and correct functioning of the machine is assured under both steady and nonsteady operating conditions. A disadvantage of this method is the high price of the nickel alloy, which here is particularly significant because the material costs of this pressure-wave machine account for more than half the manufacturing price.

The object of the invention is to avoid the use of a high-grade expensive material for the rotor and casing middle portion of a gas-dynamic pressure-wave machine, and nevertheless be able to maintain a small axial clearance between the rotor and the two side portions.

This object is achieved in that at each operating condition the casing middle portion is heated approximately simultaneously with the rotor to a temperature which is at least approximately proportional to the average rotor temperature at that operating condition. If both components are heated approximately uniformly, and provided their thermal expansion coefficients are not too widely different, the axial clearance between the rotor and the casing can vary only insignificantly, which allows a small clearance to be set from the start.

In accordance with a second aspect of this invention, the hot gas is employed to heat the casing middle portion. This of course simplifies implementation of the method because the heat medium already present in the machine is used for heating it.

A further advantage is achieved if the casing middle portion is heated from inside and outside. In this way the middle portion can heat up much more quickly.

Apparatus for implementing the method comprises means of heating the casing middle portion in proportion to the temperature rise of the rotor. The temperature of the rotor can be determined experimentally or by calculation for each phase of operation, thus making it possible to determine the desired temperature rise of the casing middle portion such that the end faces of the rotor cannot rub under any operating conditions.

In a simple constructional form, a radial gap is created between the shroud of the rotor and the casing middle portion to form a flow channel for the hot gas. The gap is present in any case, but through it there flows only a relatively small quantity of leakage gas. If a larger quantity of gas is to be passed through it, it is sufficient to ensure that the gases can flow in and out as freely as possible, if necessary by widening the gap.

Additional possibilities for heating the casing middle portion are provided by a jacket which surrounds the casing middle portion and thus forms an annular gap through which the hot gas flows. The hot gas can be used to heat the middle portion from the outside, either before or after it has given up its energy in the pressure-wave machine.

It is advantageous if the hot gas flows first through the radial gap and then through the annular gap. In this way a larger proportion of the heat contained in the gas is transferred to the casing middle portion, thus providing a saving in gas.

The method described eliminates the unfavourable behavior of the clearance in a pressure-wave machine. Formerly one had either to use a high-grade nickel alloy for the rotor and the casing middle portion, or accept a very large axial clearance on assembly in order to overcome the danger that the rotor would rub. It is now possible to use low-alloy structural steel, if it has the necessary high-temperature stability, the clearance can be set small when the machine is assembled, and even under overload conditions the means stated ensure that the rotor will not rub.

A number of examples are shown schematically in the drawings, in which.

Figure 4:
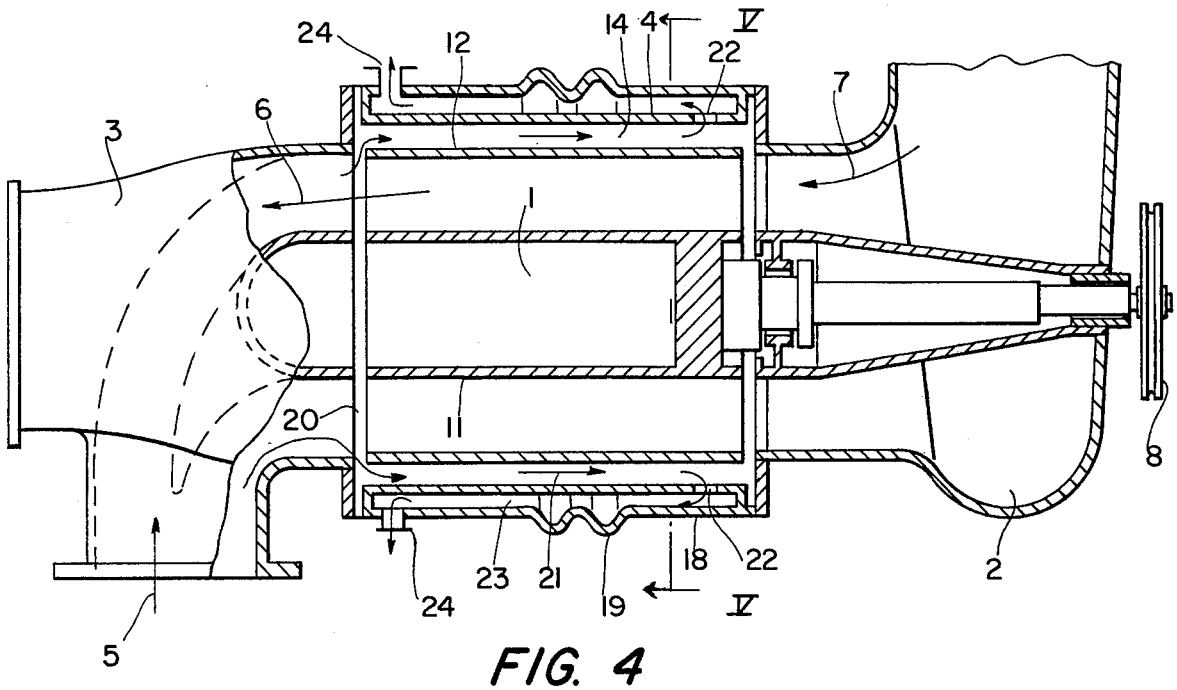
Figure 5:
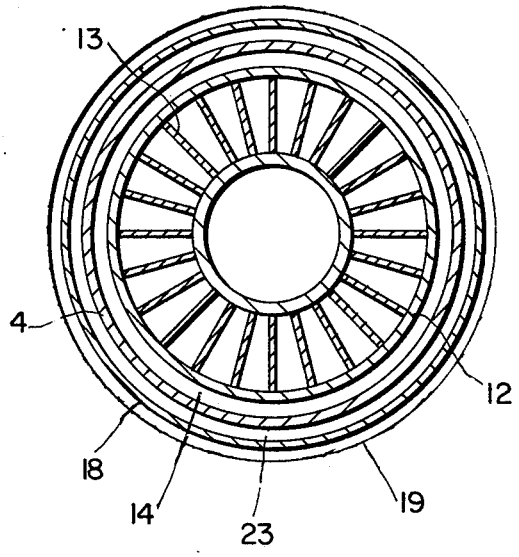

FIG. 4 is a longitudinal central section through a second embodiment of the invention wherein the middle casing portion is heated both from the inside as well as the outside by passing hot gas through inner and outer annular flow channels, the inner annular channel being established by a gap between the middle casing portion and the shroud on the rotor closing off the cells and the outer annular channel being established by a gap between the middle casing portion and a surrounding cylindrical jacket; and FIG. 5 is a transverse section taken on line V—V of FIG. 4.

Figure 1:
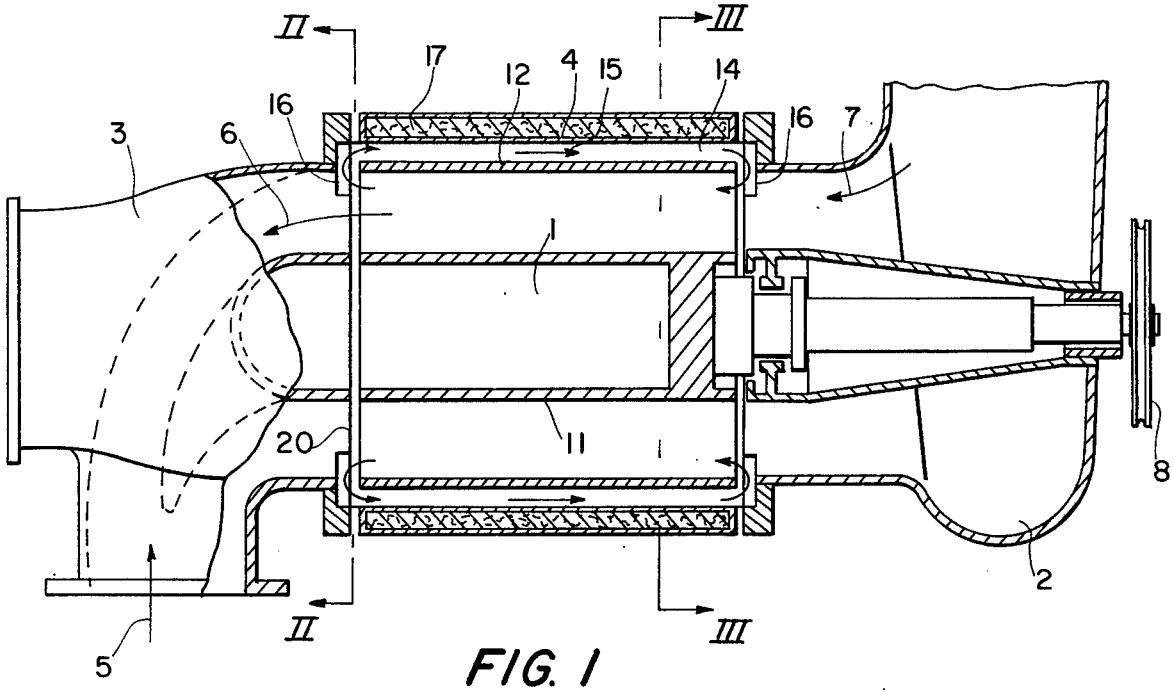
FIG. 1 is a longitudinal central section through one embodiment of the invention wherein the middle casing portion is heated from the inside by passing hot gas through an annular flow channel formed between it and the shroud which forms the radially outer wall of the rotor cells.
Figure 2:
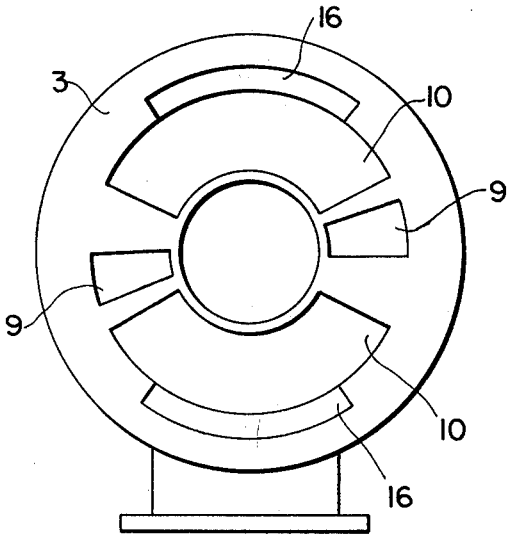
FIG. 2 shows a side portion of the casing taken along line II—II of FIG. 1.
Figure 3:
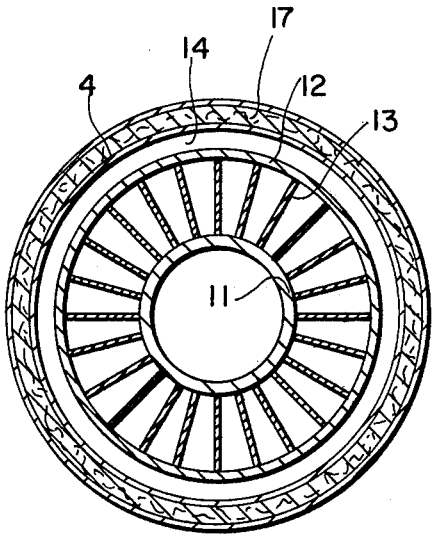
FIG. 3 is a transverse section taken on line III—III of FIG. 1.

With reference now to the drawings and to FIG. 1 in particular it will be seen that the rotor 1 rotates between fixed side portions of the casing, namely the air casing 2 and the gas casing 3, which are joined by way of the casing middle portion 4. The high-energy high-pressure gas, in this case the hot exhaust gas from an internal combustion engine, flows in the direction of the arrow 5 through the gas casing 3 and through the inlet port 9 into the rotor 1, where in the pressure-wave process it expands and imparts some of its energy to the air. It leaves the rotor again as low-pressure gas through the outlet ports 10 in the gas casing 3 and flows through the gas casing in the direction of the arrow 6, e.g. to the exhaust.

The air flows in the direction of arrow 7 through the air casing 2, it is compressed in the rotor 1 and leaves the air casing again (not shown in the drawing) in a direction perpendicular to the plane of the drawing in order to be utilised further.

The rotor 1 is mounted in an overhung bearing in air casing 2. It is driven at 8 and that part in which the pressure-wave process takes place consists of the hub 11 and the shroud 12, between which the cell walls 13 are arranged radially.

In accordance with both of the illustrated embodiments, the radial gap 14 between the shroud 12 of the rotor and the casing middle portion 4 is rather wider than is usually the case. Of the low-pressure gas leaving the rotor in direction 6, part enters the radial gap 14 and, as indicated by the arrows 15, flows towards the air casing 2 owing to the pressure difference and, together with the air flowing in the direction of arrow 7, flows into the rotor, where it takes part in the pressure-wave process. To make it easier for the low-pressure gas to flow into and out of the radial gap, through which in the case of known machines only a small quantity of leakage gas passes, the gas casing 3 and air casing 2 are provided with recesses 16 so that the radial gap, together with its suitably adapted width, becomes a definite flow channel.

The low-pressure gas, which is still hot even after it has given up energy in the rotor, is distributed in the radial gap 14, and thus heats the casing middle portion 4 uniformly to close to the temperature of the low-pressure gas. The rotor 1 is cooled by ingested fresh air on the air side and by scavenging air over the whole axial length of the cells, so that the operating temperature settles to a value between the air and gas temperatures. When the rotor is normally filled, therefore, the average temperature of the casing middle portion is at least equal to, but usually higher than, the operating temperature of the rotor.

If the casing middle portion has a lower thermal capacity than the shroud, which is an advantage, it responds very quickly to the rise in temperature and expands — practically simultaneously with the rotor or even faster still — in accordance with the gas temperature and the quantity of gas passing through the radial gap. The width of the axial gap 20 then varies only within narrow limits and the danger that the end faces of the rotor will rub is eliminated.

To afford protection against heat losses, and so allow faster heating, the casing middle portion is provided with insulation 17, which at the same time acts as acoustic insulation. An enamel coating can also be of advantage.

A further advantage of the version shown in FIG. 1 is that no external parts are required.

It is obvious that the hot gas, after it has passed along the whole length of radial gap 14, can also be extracted to the outside, e.g. direct to the surrounding atmosphere or to the exhaust, to flow away together with the low-pressure gas.

An alternative arrangement with heating of the casing middle portion from inside and outside is shown in FIGS. 4 and 5. The casing middle portion 4 is surrounded by a jacket 18, which incorporates corrugations to compensate for expansion. The heat-source medium comprises a part of the high-pressure gas which, having passed through the gas casing 3, does not flow with the main stream into the rotor, but passes through the axial gap 20 into the radial gap 14, flows through this in the direction indicated by arrow 21, leaves through the openings 22 in the casing middle portion 4, passes through the annular space 23 between the casing middle portion and the jacket 18 in the opposite direction and is extracted via the port 24 (of which there can be more than one) to pass to atmosphere, for example, or back into the gas casing 3 at a point where this partial quantity of gas, now cooled, can combine with the low-pressure gas leaving the rotor. In this way the casing middle portion is heated on both sides by the same gas, the thermal capacity of which is thus used to the best advantage. The jacket can be insulated to avoid heat losses.

Should the high-pressure gas fed through the axial gap — which must of course be kept small — not be sufficient to heat the casing middle portion, a recess can be provided in the region of each high-pressure gas inlet port 9, similar to those recesses 16 for the low-pressure gas, which will allow a larger quantity of high-pressure gas to be fed to the radial gap 14.

Here, too, it is possible to extract the high-pressure gas from the radial gap 14 by way of openings 22, without making further use of it. This arrangement may be appropriate, for example, if recirculation of exhaust gas into the pressure-wave process must be avoided.

To prevent any deformation of the casing middle portion owing to non-uniform heating, it may prove effective to distribute the high-pressure gas in the radial gap, e.g. by widening the radial gap over the whole circumference at that point where the casing middle portion is adjacent to the gas casing.

It is self-evident that low-pressure gas can similarly be used for heating the casing middle portion on both sides. The jacket 18 can also be used for heating the casing middle portion from the outside only, by introducing high-pressure or low-pressure gas direct into the annular space 23.

We claim:

1. In a gas-dynamic pressure-wave machine comprising essentially a celled rotor including a cylindrical shroud forming the radially outer wall of the cells and operating within a stationary casing that includes a cylindrical middle portion co-extensive in length with and surrounding said shroud and two side casing portions located respectively adjacent opposite ends of said rotor for entrance and discharge of a hot gas to be expanded and a cold gas such as air to be compressed respectively which flow through the cells whereby some of the energy in said hot gas is imparted to said cold gas to cause the latter to be compressed accompanied by heating of said rotor and axial expansion thereof, the improvement wherein to prevent any rubbing action between the surfaces of said side casing portions and the opposite ends of said rotor as a result of its axially directed thermal expansion and yet maintain a desirable small axial operating clearance therebetween, the internal diameter of said cylindrical middle portion of said casing exceeds the external diameter of said shroud by an amount sufficient to establish an axially extending annular flow channel therebetween through which said hot gas flows from one end of said middle casing portion to the other thereby heating the latter for each operating condition approximately simultaneously with said rotor to a temperature which is at least approximately proportional to the average rotor temperature at that operating condition, and said machine includes at least one recess in each of said two side casing portions through which the said hot gas flows to or from said axially extending flow channel.

2. In a gas-dynamic pressure-wave machine comprising essentially a celled rotor including a cylindrical shroud forming the radially outer wall of the cells and operating within a stationary casing that includes a cylindrical middle portion co-extensive in length with and surrounding said shroud and two side casing portions located respectively adjacent opposite ends of said rotor for entrance and discharge of a hot gas to be expanded and a cold gas such as air to be compressed respectively which flow through the cells whereby some of the energy in said hot gas is imparted to said cold gas to cause the latter to be compressed accompanied by heating of said rotor and axial expansion thereof, the improvement wherein to prevent any rubbing action between the surfaces of said side casing portions and the opposite ends of said rotor as a result of its axially directed thermal expansion and yet maintain a desirable small axial operating clearance therebetween, said pressure wave machine includes a cylindrical jacket surrounding said cylindrical middle portion of said casing and spaced radially from the latter to establish an axially extending annular flow channel therebetween through which said hot gas flows from one of said middle casing portion to the other thereby heating the latter for each operating condition approximately simultaneously with said rotor to a temperature which is at least approximately proportional to the average rotor temperature at that operating condition.

3. In a gas-dynamic pressure-wave machine comprising essentially a celled rotor including a cylindrical shroud forming the radially outer wall of the cells and operating within a stationary casing that includes a cylindrical middle portion co-extensive in length with and surrounding said shroud and two side casing portions located respectively adjacent opposite ends of said rotor for entrance and discharge of a hot gas to be expanded and a cold gas such as air to be compressed respectively which flow through the cells whereby some of the energy in said hot gas is imparted to said cold gas to cause the latter to be compressed accompanied by heating of said rotor and axial expansion thereof, the improvement wherein to prevent any rubbing action between the surfaces of said side casing portions and the opposite ends of said rotor as a result of its axially directed thermal expansion and yet maintain a desirable small axial operating clearance therebetween, said pressure wave machine includes a cylindrical jacket surrounding said cylindrical middle portion of said casing and spaced radially from the latter to establish an axially extending outer annular flow channel therebetween and the internal diameter of said cylindrical middle portion of said casing exceeds the external diameter of said shroud by an amount sufficient to establish an axially extending inner annular flow channel therebetween, said hot gas being passed through said inner and outer annular flow channels from one end thereof to the other thereby heating said cylindrical middle portion of said casing both from the inside and outside for each operating condition approximately simultaneously with said rotor to a temperature which is at least approximately proportional to the average rotor temperature at that operating condition.

4. A gas-dynamic pressure-wave machine as defined in claim 3 wherein said inner and outer flow channels are interconnected at one end thereof whereby said hot gas flows first through one of said channels in one direction and thence in the opposite direction through the other said channel.

5. A gas-dynamic pressure-wave machine as defined in claim 4 wherein said hot gas flows first through said inner annular channel and thence through said outer annular channel.

* * * * *